US009542868B2

(12) United States Patent
Lin

(10) Patent No.: US 9,542,868 B2
(45) Date of Patent: Jan. 10, 2017

(54) LIGHT EMITTING DEVICE, SURFACE MOUNTED DEVICE-TYPE LIGHT EMITTING DEVICE, AND DISPLAY DEVICE

(71) Applicant: Jung Chiuan Lin, New Taipei (TW)

(72) Inventor: Jung Chiuan Lin, New Taipei (TW)

(73) Assignee: Everlight Electronics Co., Ltd. (TW)

( * ) Notice: Subject to any disclaimer, the term of this patent is extended or adjusted under 35 U.S.C. 154(b) by 920 days.

(21) Appl. No.: 13/664,709

(22) Filed: Oct. 31, 2012

(65) Prior Publication Data

US 2013/0107497 A1 May 2, 2013

(30) Foreign Application Priority Data

Oct. 31, 2011 (TW) ..... 100139619 A

(51) Int. Cl.

| | |
|---|---|
| ***G09F 13/04*** | (2006.01) |
| *F21Y 105/00* | (2016.01) |
| *F21Y 101/02* | (2006.01) |
| *F21V 19/00* | (2006.01) |
| *F21Y 101/00* | (2016.01) |

(52) U.S. Cl.

CPC ..... *G09F 13/04* (2013.01); *F21V 19/0015* (2013.01); *F21Y 2101/00* (2013.01); *F21Y 2101/02* (2013.01); *F21Y 2105/00* (2013.01); *F21Y 2105/008* (2013.01); *F21Y 2115/15* (2016.08); *F21Y 2115/30* (2016.08)

(58) Field of Classification Search

CPC G06F 13/04; F21V 19/0015; F21Y 2105/008; F21Y 2101/025; F21Y 2101/02; F21Y 21/00

See application file for complete search history.

(56) References Cited

U.S. PATENT DOCUMENTS

| | | | | |
|---|---|---|---|---|
| 7,199,452 | B2 | 4/2007 | Takase | |
| D609,654 | S | 2/2010 | Hsieh | |
| D619,111 | S | 7/2010 | Wu et al. | |
| D656,907 | S | 4/2012 | Wu et al. | |
| D657,321 | S | 4/2012 | Wu et al. | |
| D676,396 | S | 2/2013 | Lin | |
| 2008/0186714 | A1 | 8/2008 | Nagayama | |
| 2008/0272383 | A1 | 11/2008 | Loh | |
| 2009/0141468 | A1* | 6/2009 | Yang | 361/807 |

(Continued)

FOREIGN PATENT DOCUMENTS

| | | |
|---|---|---|
| CN | 2646873 | 10/2004 |
| CN | 101232007 | 7/2008 |

(Continued)

*Primary Examiner* — Y M Lee

(74) *Attorney, Agent, or Firm* — Han IP Corporation

(57) ABSTRACT

Embodiments of a light emitting device, a surface mounted device-type light emitting device and a display device are provided. In one aspect, a light emitting device may include a main body and a light source. The main body may include a base and a number of terminals. The base may have a support surface. Each of the terminals may respectively have a welding portion such that the welding portions of the terminals form a connection surface with a first angle between the support surface and the connection surface. The first angle may be between 0 degree and 90 degrees. The light source may be disposed on the support surface and electrically connected to one or more of the terminals.

13 Claims, 9 Drawing Sheets

(56) References Cited

U.S. PATENT DOCUMENTS

2010/0157595 A1* 6/2010 Lin et al. ..... 362/235

FOREIGN PATENT DOCUMENTS

| | | | |
|---|---|---|---|
| CN | 101271887 | A | 9/2008 |
| CN | 101994925 | | 3/2011 |
| CN | 301942829 | | 5/2012 |
| CN | 103090217 | | 5/2013 |
| EA | 001322663-0001 | | 4/2012 |
| JP | D1332784 | | 6/2008 |
| JP | D1357437 | | 4/2009 |
| JP | 2011-071333 | | 4/2011 |
| KR | 30-0382756 | | 5/2005 |
| KR | 30-0465248 | | 10/2007 |
| TW | D114623 | | 12/2006 |
| TW | 200824058 | | 6/2008 |
| TW | 200830581 | | 7/2008 |
| TW | 200933923 | | 8/2009 |
| TW | D132331 | | 12/2009 |
| TW | 201025559 | | 7/2010 |
| TW | I331664 | | 10/2010 |
| TW | M400100 | | 3/2011 |
| TW | D139847 | | 4/2011 |
| TW | D148154 | | 7/2012 |
| TW | 201318225 | | 5/2013 |

* cited by examiner

LIGHT EMITTING DEVICE, SURFACE MOUNTED DEVICE-TYPE LIGHT EMITTING DEVICE, AND DISPLAY DEVICE

CROSS-REFERENCE TO RELATED APPLICATION

This application claims the priority benefit of Taiwan Patent Application No. 100139619, filed on Oct. 31, 2011. The entirety of the above-identified patent application is hereby incorporated by reference.

BACKGROUND

Technical Field

The present invention relates to a light emitting device and, more particularly, to a type of tilted light emitting device, surface mounted device-type light emitting device and display.

Description of Related Art

Light-emitting diodes (LED) are a type of semiconductor light-emitting components. Chemical compounds primarily of III-V chemical elements are used in LED chips, such as gallium nitride (GaN), gallium phosphide (GaP), or gallium arsenide (GaAs), and the light-emitting principle involves conversion of electrical energy to photonic energy. More specifically, by applying an electrical current through the compound semiconductor of the LED, excess energy is released in the form of light by the combination of electrons and holes. As light emission by LEDs is not through heating to glow or electric discharge, the life of LEDs is generally longer than 100,000 hours. Moreover, LEDs tend to have the advantages of fast response, compact size, power-saving, low pollution, high reliability, and suitability for mass production, etc. Accordingly, there are a wide variety of applications of LEDs, including the light sources large billboards, traffic lights, mobile phones, scanners, fax machines, and LED lamps, etc.

Surface mounted device-type LEDs typically include an LED chip, a support surface and multiple welding surfaces. The LED chip has an optical axis and is disposed on the support surface. The welding surfaces are typically disposed on a surface of a circuit board so that the LED chip is electrically connected to the circuit board through the welding surfaces. When the welding surfaces are perpendicular to the optical axis of the LED the support surface and the welding surfaces are parallel, and the general direction of light emission of the LED chip is perpendicular to the welding surfaces. Traditionally LEDs of this type are known as top view LEDs. When the welding surfaces are parallel with the optical axis of the LED the support surface and the welding surfaces are perpendicular, and the general direction of light emission of the LED chip is parallel with the welding surfaces. Traditionally LEDs of this type are known as side view LEDs in the industry. The general direction of light emission needs to be adjusted to provide good illumination, backlight or display effects to suit the demands of illumination, backlight or display in various environments. However, additional parts that support the LED structure are often necessary to allow tilting for adjustment in the general direction of light emission, and this would increase the manufacturing cost and assembly time.

SUMMARY

The present invention provides a light emitting device that emits light generally in a tilted direction relative to a surface on which the light emitting device is mounted on or otherwise affixed to.

According to one aspect, a light emitting device may comprise a main body and a light source. The main body may comprise a base and a number of terminals. The base may have a support surface. Each of the terminals may respectively have a welding portion such that the welding portions of the terminals form a connection surface with a first angle between the support surface and the connection surface. The first angle may be between 0° and 90°. The light source may be disposed on the support surface and electrically connected to one or more of the terminals.

In at least some embodiments, the first angle may be substantially 45°.

In at least some embodiments, the main body may further comprise a receiving slot in which the support surface and the light source are disposed. An opening of the receiving slot may define a light incident plane on the main body.

In at least some embodiments, a second angle between the light incident plane and the support surface may be between 0° and 90°.

In at least some embodiments, the light incident plane and the support surface may be parallel.

In at least some embodiments, the main body may further comprise at least one supporting portion protruding from the base. The at least one supporting portion may maintain a third angle between the main body and the affixation terminal when the main body is disposed on the affixation terminal with the supporting portion in contact with the affixation terminal.

In at least some embodiments, at least a first one of the terminals may extend from a region where the main body and the light source are connected in a first direction around a side surface of the base and toward a bottom surface of the base that is opposite to the support surface. At least a second one of the terminals may extend from the region where the main body and the light source are connected in a second direction around the side surface of the base and toward the bottom surface of the base. The first direction and the second direction may be opposite to each other.

According to another aspect, a surface mounted device-type light emitting device may comprise a main body and an LED chip. The main body may comprise a base and a plurality of terminals. The base may have a support surface. Each of the terminals may respectively include a welding portion. The welding portions of the terminals may form a connection surface such that the support surface is tilted relative to the connection surface with a first angle between the connection surface and the support surface. The first angle may be between 0° and 90°. The LED chip may be disposed on the support surface and electrically connected to one or more of the terminals.

In at least some embodiments, the first angle may be substantially 45°.

In at least some embodiments, the main body may further comprise a receiving slot in which the support surface and the LED chip are disposed.

In at least some embodiments, the main body may further comprise a translucent encapsulant filled in the receiving slot of the main body and covering the LED chip.

In at least some embodiments, an opening of the receiving slot may define a light incident plane on the main body. A second angle between the light incident plane and the support surface may be between 0° and 90°.

In at least some embodiments, an opening of the receiving slot may define a light incident plane on the main body. The light incident plane and the support surface may be parallel.

In at least some embodiments, the main body may further comprise at least one supporting portion protruding from the base. The at least one supporting portion may maintain a third angle between the main body and the affixation terminal when the main body is disposed on the affixation terminal with the supporting portion in contact with the affixation terminal.

In at least some embodiments, at least a first one of the terminals may extend from a region where the main body and the LED chip are connected in a first direction around a side surface of the base and toward a bottom surface of the base that is opposite to the support surface. At least a second one of the terminals may extend from the region where the main body and the LED chip are connected in a second direction around the side surface of the base and toward the bottom surface of the base. The first direction and the second direction may be opposite to each other.

According to yet another aspect, a display device may comprise a display panel, a frame in which the display panel is received, and a plurality of light emitting devices embedded in the frame. Each of the light emitting devices may respectively comprise a main body and a light source. The main body may comprise a base and a plurality of terminals. The base may include a support surface. Each of the terminals may respectively include a welding portion such that the welding portions of the terminals form a connection surface. The support surface may be tilted relative to the connection surface. The light source may be disposed on the support surface and electrically connected to one or more of the terminals.

In at least some embodiments, the support surface may be tilted relative to the connection surface by a first angle, and wherein the first angle is between 0° and 90°.

In at least some embodiments, the main body of at least one of the light emitting devices may further comprise a receiving slot in which the respective support surface and light source are disposed. An opening of the receiving slot may define a light incident plane with a second angle between the light incident plane and the support surface. The second angle may be between 0° and 90°.

In at least some embodiments, the main body of at least one of the light emitting devices may further comprise at least one supporting portion protruding from the respective base. The at least one supporting portion may maintain a third angle between the main body and the affixation terminal when the main body is disposed on the affixation terminal with the supporting portion in contact with the affixation terminal.

In at least some embodiments, at least a first one of the terminals may extend from a region where the main body and the light source are connected in a first direction around a side surface of the base and toward a bottom surface of the base that is opposite to the support surface. At least a second one of the terminals may extend from the region where the main body and the light source are connected in a second direction around the side surface of the base and toward the bottom surface of the base, and wherein the first direction and the second direction are opposite to each other.

Detailed description of various embodiments are provided below, with reference to the attached figures, to promote better understanding of the characteristics and benefits of the various embodiments of the present invention.

DETAILED DESCRIPTION OF PREFERRED EMBODIMENTS

Figure 1:
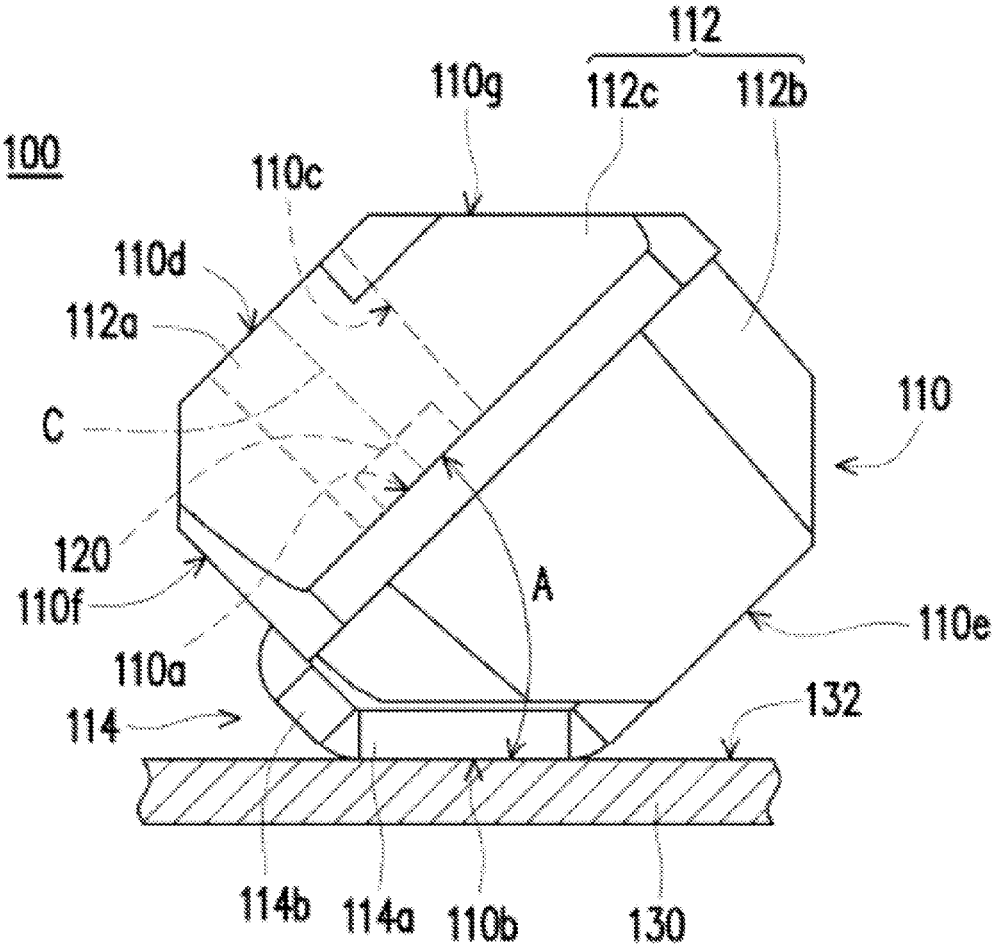
FIG. 1 is a side view of a light emitting device in accordance with an embodiment of the preset invention.
Figure 2:
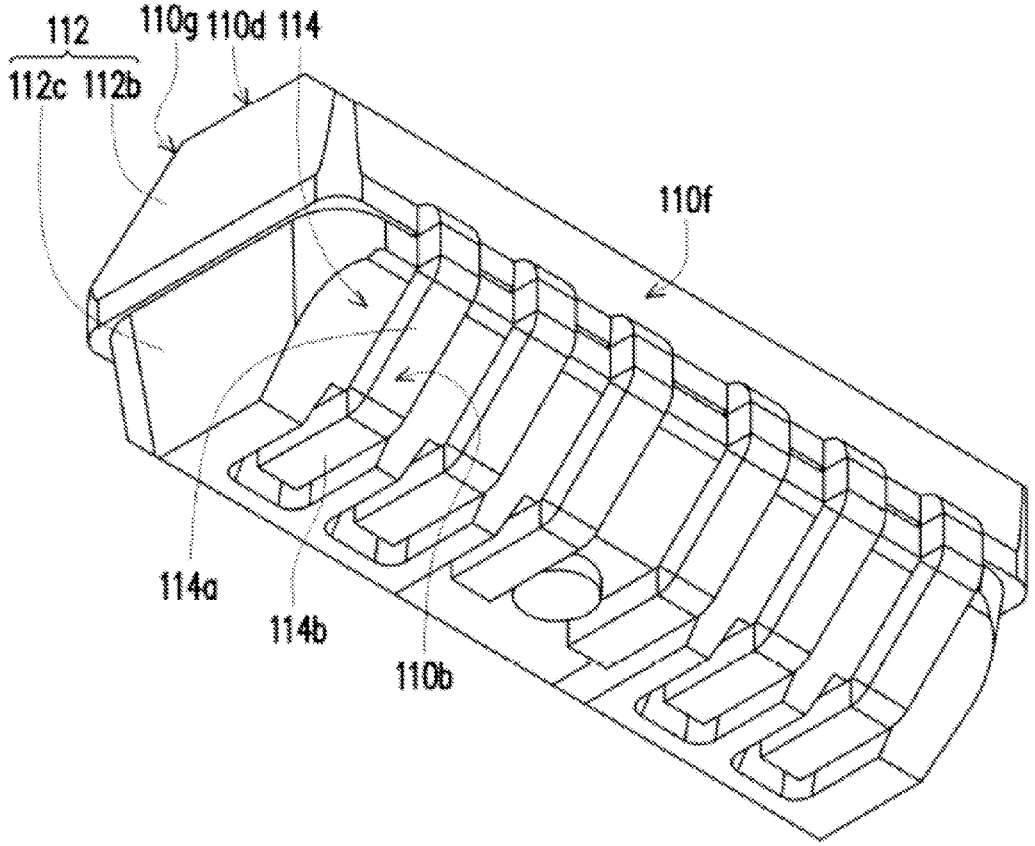
FIG. 2 is a perspective view of a main body the light emitting device of FIG. 1.

FIG. 1 illustrates a side view of a light emitting device 100 in accordance with an embodiment of the preset invention. FIG. 2 illustrates a perspective view of the light emitting device 100. Referring to FIG. 1 and FIG. 2, the light emitting device 100 may include a main body 110 and a light source 120. The main body 110 may have a support surface 110*a* and a connection surface 110*b*. The connection surface 110*b* may be configured to be connected to an affixation terminal 132. As the support surface 110*a* and the connection surface 110*b* form an angle A, the support surface 110*a* is tilted relative to the connection surface 110*b*.

In at least some embodiments, the light emitting device 100 may include an LED having an LED chip as the light source 120 that is disposed on the support surface 110*a*. An optical axis C of the light source 120 may be perpendicular to the support surface 110*a* and thus tilted relative to the connection surface 110*b*. A surface of the main body 110 used as a bonding region or wiring region for the LED chip may comprise the support surface 110*a*. In other embodiments, the light source 120 may include one or more laser diodes, one or more organic electro-luminescent devices (OLED), or one or more other suitable light-emitting components. Embodiments of the present invention are not limited thereto.

When the connection surface 110*b* of the main body 110 is connected to the affixation terminal 132 the light source 120, which is disposed on the support surface 110*a*, is tilted relative to the affixation terminal 132. Accordingly, it is not necessary to use additional parts to support the main body 110 to render the direction of the optical axis C of light emitted from the light emitting device 100 to be tilted, thereby saving manufacturing cost and reducing assembly time.

In at least some embodiments, the angle A between the connection surface 110*b* and the support surface 110*a* may be an angle that is greater than 0 degree (0°) and less than 90 degrees (90°). As an illustration, in at least some embodiments, the angle A between the connection surface 110*b* and the support surface 110*a* may be, for example but not limited to, substantially 45 degrees (45°). In other embodiments, the angle A between the connection surface 110*b* and the support surface 110*a* may be an acute angle suitable to the particular design, e.g., 30 or 60 degrees, so that the general direction of light emitted from the light source 120 is tilted relative to the affixation terminal 132.

Referring to FIG. 1, in at least some embodiments, the light emitting device 100 may further include a circuit board 130 having a surface 132 which is the affixation terminal 132, and the main body 110 may include a base 112 and one or more terminals 114. Each of the one or more terminals 114 may be electrically conductive, thermally conductive, or both electrically and thermally conductive. The support surface 110*a* may be formed on the base 112. At least one of the one or more terminals 114 may be electrically connected to the light source 120 for connecting electrical power to the light source 120. In one embodiment, at least one of the one or more terminals 114 is electrically connected to the light source 120 for connecting electrical power to the light source 120 while at least another one of the one or more terminals 114 is not electrically connected to the light source 120 but used for structurally attaching the main body 110 to the affixation terminal 132. In one embodiment, each of the one or more terminals 114 is electrically connected to the light source 120 for connecting electrical power to the light source 120. Each of the one or more terminals 114 may include a welding portion 114*a*. The one or more welding portions 114*a* may form the connection surface 110*b* and may be welded to the surface 132 of the circuit board 130 (i.e., the affixation terminal 132) so that the light source 120 is electrically connected to the circuit board 130 through at least one of the one or more terminals 114. In one embodiment, the light source 120 is electrically connected to the circuit board 130 through all of the one or more terminals 114.

Under traditional configurations, the optical axis of the light source or the support surface on which the light source is disposed is usually parallel with or perpendicular to the circuit board. As such a user would need to tilt the circuit board in order to tilt the general direction of the light emitted from the light emitting device. In contrast, given the built-in tilting of the support surface 110*a* of the main body 110 relative to the circuit board 130, in the present embodiment there is no need to tilt the circuit board 130 in order to tilt the general direction of light emitted from the light emitting device 100.

In at least some embodiments, the main body 110 may include a bottom surface 110*e* and a side surface 110*f*. The bottom surface 110*e* may be opposite to and optionally parallel with the support surface 110*a*, and the side surface 110*f* may be perpendicular to the support surface 110*a*. As the main body 110 may be connected to the surface 132 of the circuit board 130 via the connection surface 110*b*, the bottom surface 110*e* and the side surface 110*f* may not be in contact with the circuit board 130 and thus may be spaced apart from the affixation terminal 132 (which is the surface 132 of the circuit board 130). Moreover, the main body 110 may further include an suction surface 110*g*. During the manufacturing process of the light emitting device 100, the main body 110 may be moved or transported by using the vacuum nozzle to suck the suction surface 110*g* to further the progress of the manufacturing process.

Figure 3:
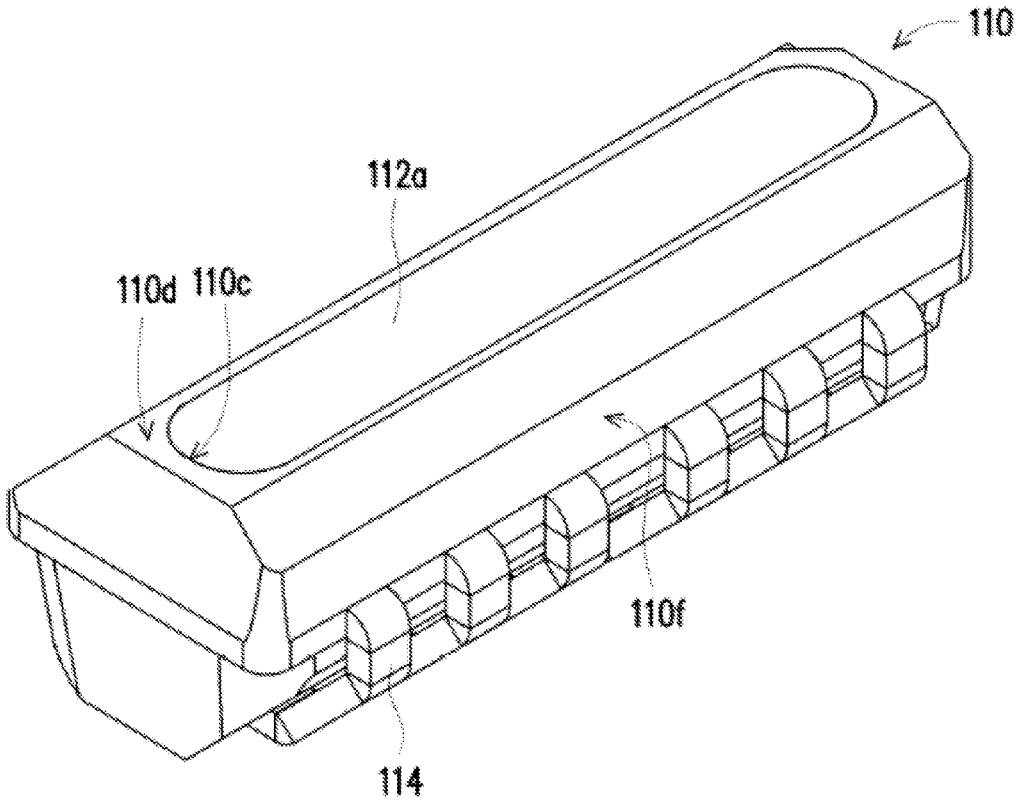
FIG. 3 is another perspective view of the main body of FIG. 2.

FIG. 3 illustrates another perspective view of the main body 110 of the light emitting device 100. Referring to FIG. 1 and FIG. 3, in at least some embodiments, the main body 110 may include a receiving slot 110*c*. With the support surface 110*a* and the light source 120 in the receiving slot 110*c*, the light source 120 is not exposed and thus protected. Additionally, in at least some embodiments, the base 112 may further include a translucent encapsulant 112*a*, e.g., translucent colloid or resin, filled in the receiving slot 110*c* and covering the light source 120 to further protect and affix the light source 120. In one embodiment, the base 112 may further include a transparent encapsulant 112*a*, e.g., transparent colloid or resin, filled in the receiving slot 110*c* and covering the light source 120 to further protect and affix the light source 120.

In at least some embodiments, a material of the base 112 may be, for example, plastic and manufactured by injection molding. A material of the translucent encapsulant 112*a* or the transparent encapsulant may be, for example, silicone, epoxy, acrylic resin, or other suitable material. In other embodiments, other materials may be utilized for the base 112 and the translucent encapsulant 112*a* or the transparent encapsulant, and the present invention is not limited thereto.

In at least some embodiments, the base 112 may include a first portion 112*b* and a second portion 112*c* that are connected together, and the receiving slot 110*c* may be formed in the second portion 112*c*. Each of the one or more terminals 114 may further include a connection portion 114*b* that is connected to the respective welding portion 114*a*. The welding portion 114*a* of at least one terminal 114 may be connected to, mounted on or otherwise affixed to the first portion 112*b* of the base 112, with the respective connection portion 114*b* extending toward the second portion 112*c* of the base 112 and electrically connected to the light source 120 in the receiving slot 110*c*. In one embodiment as shown in FIG. 2, each of the one or more terminals 114 may extend in the same direction from a region where the second portion 112*c* and the light source 120 are connected toward the bottom surface 110*e*, and may lay flat against a side surface of the first portion 112*b* to extend along the side surface of the first portion 112*b* with the respective connection portion 114*b* and the welding portion 114*a* disposed on the side surface of the first portion 112*b*. In other words, in one embodiment the one or more terminals 114 at least partially wrap around the base 112 in the same direction. Additionally, the region where the second portion 112*c* and the light source 120 are connected may be a LED chip bonding region or wiring region of the base 112. Also, the connection portions 114*b* and the welding portions 114*a* may be an integrally-molded single structure. In one embodiment, the connection portion 114*b* is perpendicular to the support surface 110*a*. In one embodiment, the connection portion 114*b* is perpendicular to the region where the second portion 112*c* and the light source 120 are connected. In one embodiment, the connection portion 114*b* is parallel to the optical axis C of the light source 120. Moreover, the cross section of the exterior contour of the first portion 112*b* may be of any polygonal shape, such as a pentagon for example. Furthermore, the cross section of the exterior contour of the second portion 112*c* may be any polygonal shaped, such as a hexagon for example.

In at least some embodiments, the main body 110 may include a light incident plane 110*d* defined by an opening of the receiving slot 110*c* on the main body 110. The light incident plane 110*d* may be parallel with the support surface 110*a* as shown in FIG. 1. An angle B between the light incident plane 110*d* and the support surface 110*a* may be between 0 degree (0°) and 90 degrees (90°), and the present invention is not limited to any particular angle between the light incident plane 110*d* and the support surface 110*a*. In the example shown in FIGS. 1-3, the angle B may be 0 degree as the light incident plane 110*d* may be parallel with the support surface 110*a*, and accordingly angle B is not shown in FIG. 1.

Figure 4:
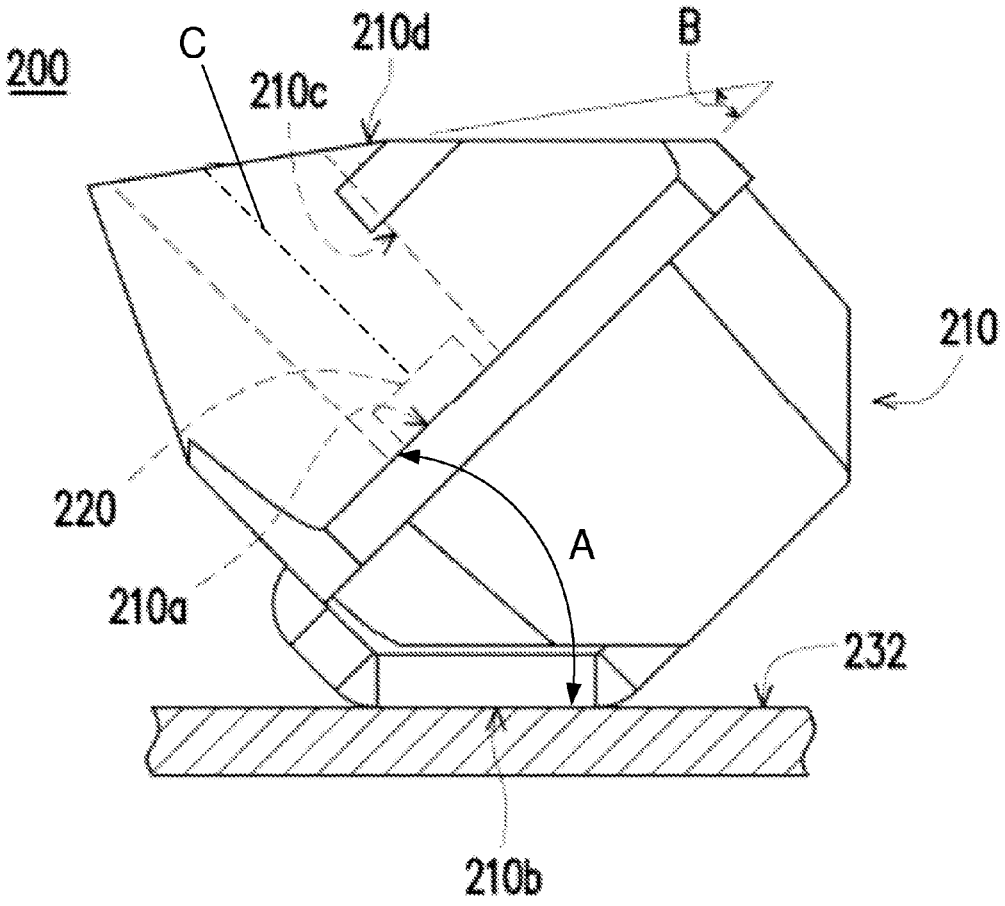
FIG. 4 is a side view of a light emitting device in accordance with another embodiment of the present invention.

FIG. 4 illustrates a light emitting device 200 in accordance with another embodiment of the present invention. Referring to FIG. 4, in at least some embodiments, the light emitting device 200 may include a main body 210 and a light source 220. The main body 210 may include a support surface 210*a*, a connection surface 210*b*, a receiving slot 210*c*, and a light incident plane 210*d*. The connection surface 210*b* may be configured to be connected to an affixation terminal 232, and the support surface 210*a* may be tilted relative to the connection surface 210*b*. The support surface 210*a* may be located in the receiving slot 210*c*. The light source 220 may be disposed on the support surface 210*a* with an opening of the receiving slot 210*c* on the light incident plane 210*d*.

In at least some embodiments, the light emitting device 200 may include an LED having an LED chip as the light source 220 that is disposed on the support surface 210*a*. An optical axis C of the light source 220 may be perpendicular to the support surface 210*a* and thus tilted relative to the connection surface 210*b*. A surface of the main body 210 used as a bonding region or wiring region for the LED chip may comprise the support surface 210*a*. In other embodiments, the light source 220 may include one or more laser diodes, one or more OLEDs, or one or more other suitable light-emitting components. Embodiments of the present invention are not limited thereto.

A difference between the light emitting device 200 and the light emitting device 100 of FIG. 1 is that the light incident plane 210*d* may be tilted relative to the support surface 210*a*. In other embodiments, the amount of tilting of the light incident plane 210*d* relative to the support surface 210*a* may be any suitable angle depending on requirements for the appearance of the light emitting device 200 or other design considerations. As shown in FIG. 4, an angle B between the light incident plane 210*d* and the support surface 210*a* may be between 0 degree (0°) and 90 degrees (90°), and the present invention is not limited to any particular angle between the light incident plane 210*d* and the support surface 210*a*. In one embodiment, the angle B is an acute angle.

Figure 5:
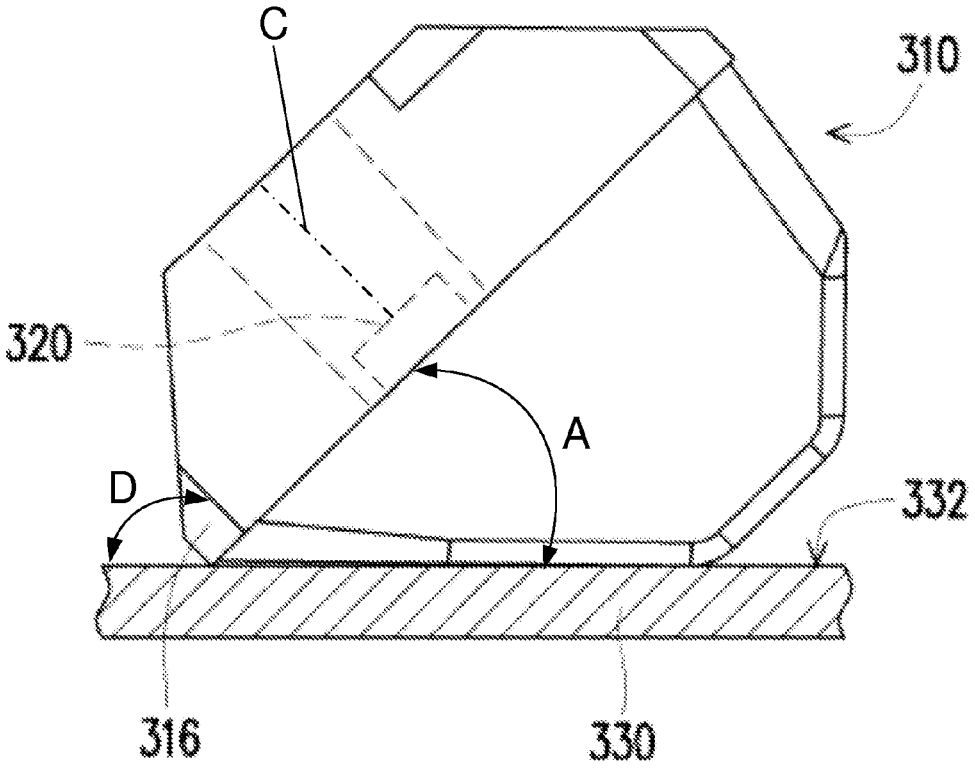
FIG. 5 is a side view of a light emitting device in accordance with yet another embodiment of the present invention.
Figure 6:
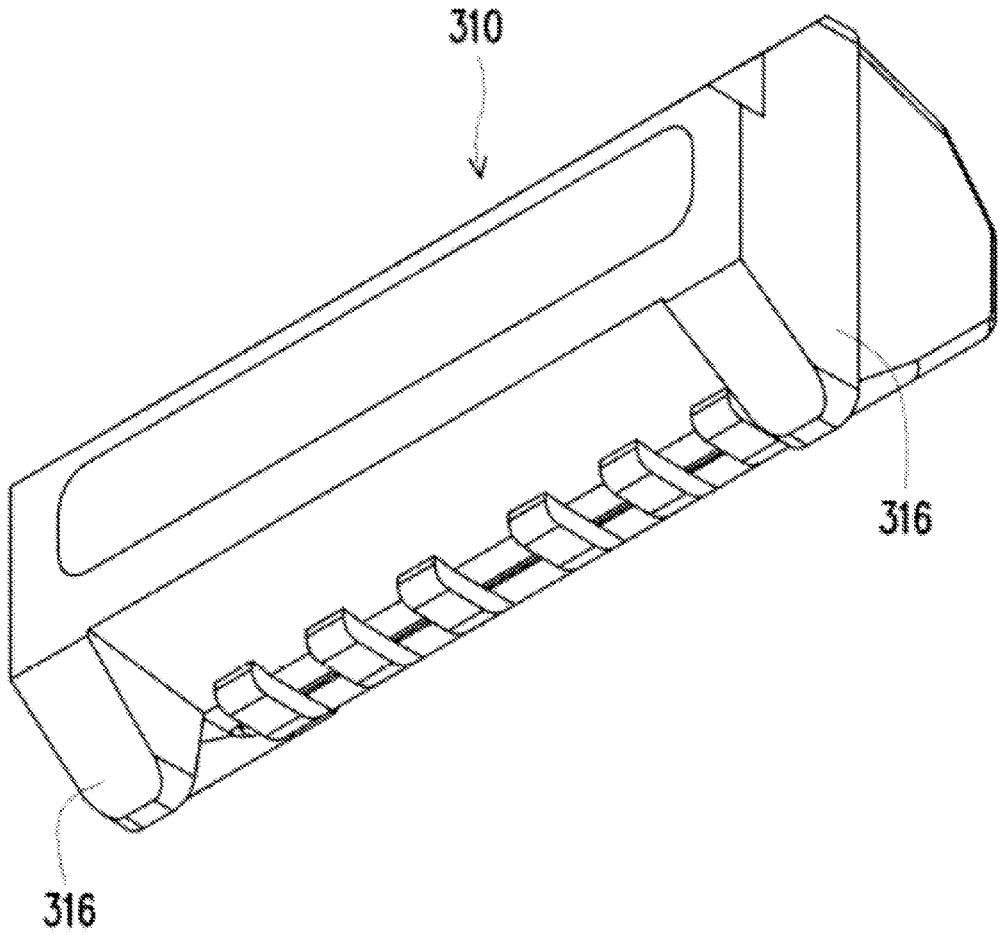
FIG. 6 is a perspective view of a main body of the light emitting device of FIG. 5.

FIG. 5 illustrates a light emitting device 300 in accordance with yet another embodiment of the present invention. FIG. 6 illustrates a perspective view of a main body 310 of the light emitting device 300. Referring to FIG. 5 and FIG. 6, in at least some embodiments, the main body 310 of the light emitting device 300 may be similar to the main body 110 of FIG. 1, and the arrangement of the main body 310 relative to a circuit board 330 may be similar to the arrangement of the main body 110 relative to the circuit board 130. In the interest of brevity detailed description thereof is not repeated.

In at least some embodiments, the light emitting device 300 may include an LED having an LED chip as a light source 320. In other embodiments, the light source 320 may include one or more laser diodes, one or more OLEDs, or one or more other suitable light-emitting components. Embodiments of the present invention are not limited thereto.

A difference between the light emitting device 300 and the light emitting device 100 of FIG. 1 is that the main body 310 may include one or more supporting portions 316. FIG. 5 shows that two supporting portions 316, disposed on the two ends of the main body 310, protrude from the main body 310 and come in direct contact with the affixation terminal 332 (which is a surface of the circuit board 330) to support the main body 310 at an angle D relative to the affixation terminal 332 so that the entire structure is sturdy. It would be appreciated by those skilled in the art that, although two supporting portions 316 are shown in the example of FIG. 5, in other embodiments the actual quantity of the supporting portions 316 may be more or less (e.g., one, three or four) than that shown in FIG. 5. For example, in one embodiment, the main body 310 may have one supporting portion 316 and, in another embodiment, the main body 310 may have three supporting portions 316, and so on.

Figure 7:
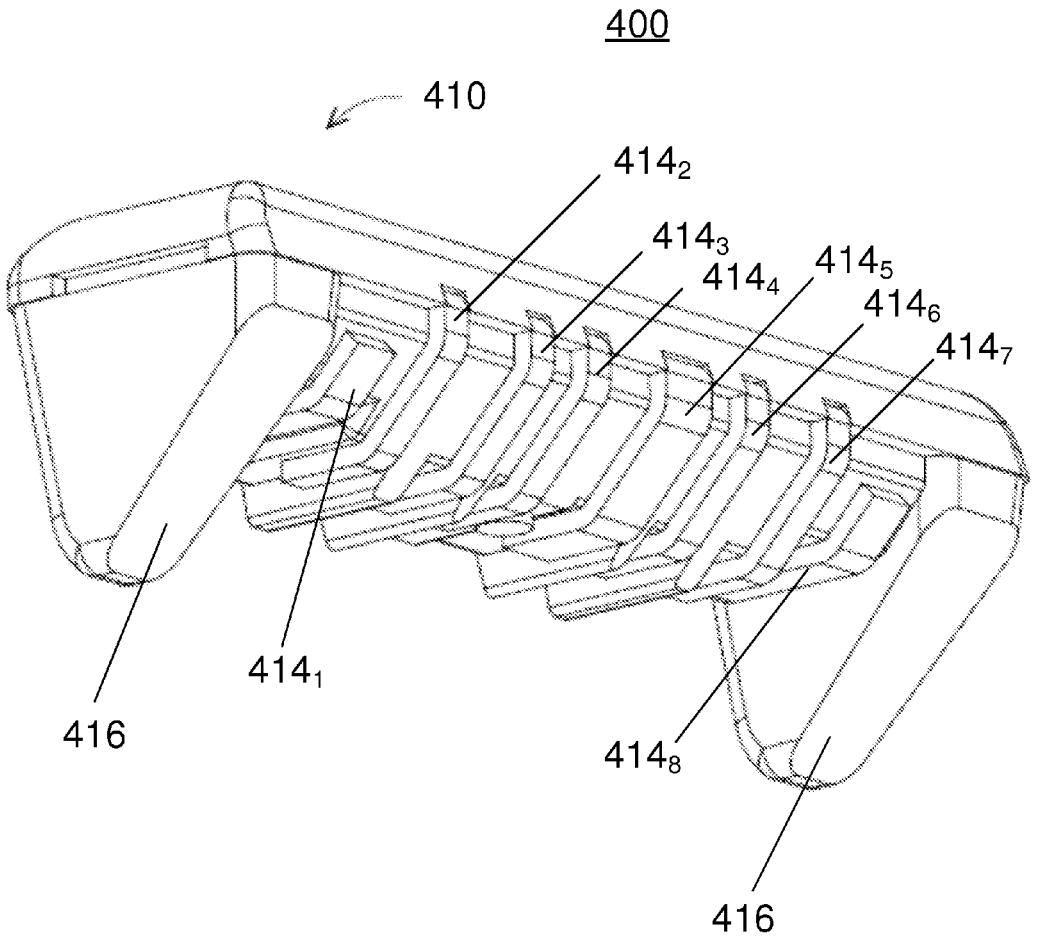
FIG. 7 is a perspective view of a light emitting device in accordance with a further embodiment of the present invention.
Figure 8:
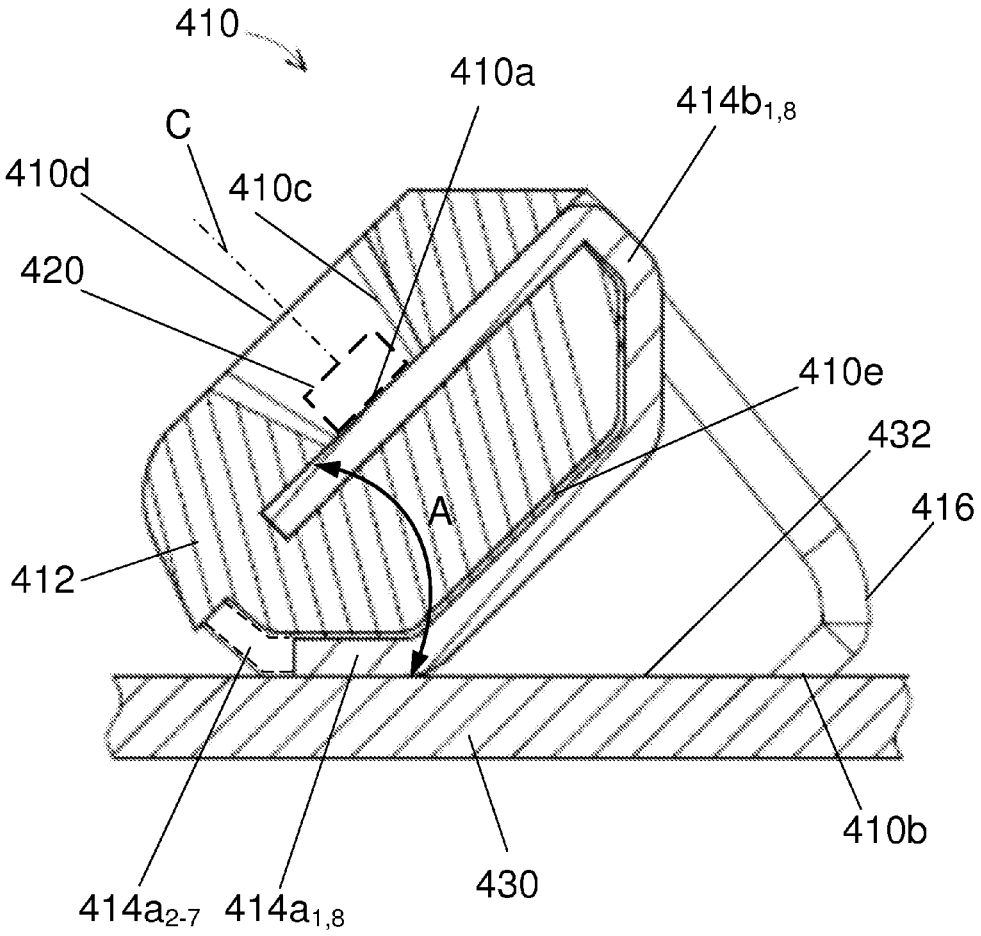
FIG. 8 is a side view of a cross section of the light emitting device of FIG. 7.

FIG. 7 illustrates a light emitting device 400 in accordance with a further embodiment of the present invention. FIG. 8 illustrates a side view of a cross section of the light emitting device 400. Referring to FIG. 7 and FIG. 8, the light emitting device 400 may include a main body 410 and a light source 420. The main body 410 may have a support surface 410*a* and a connection surface 410*b*. The connection surface 410*b* may be configured to be connected to an affixation terminal 432. The support surface 410*a* may be tilted relative to the connection surface 410*b*. In at least some embodiments, the light emitting device 400 may include an LED having an LED chip as a light source 420 that is disposed on the support surface 410*a*. An optical axis C of the light source 420 may be perpendicular to the support surface 410*a* and thus tilted relative to the connection surface 410*b*. A surface of the main body 410 used as a bonding region or wiring region for the LED chip may comprise the support surface 410*a*. In other embodiments, the light source 420 may include one or more laser diodes, one or more OLEDs, or one or more other suitable light-emitting components. Embodiments of the present invention are not limited thereto.

When the connection surface 410*b* of the main body 410 is connected to the affixation terminal 432, the light source 420, which is disposed on the support surface 410*a*, is tilted relative to the affixation terminal 432. Accordingly, it is not necessary to use additional parts to support the main body 410 to render the direction of the optical axis C of light emitted from the light emitting device 400 to be tilted, thereby saving manufacturing cost and reducing assembly time.

In at least some embodiments, an angle A between the connection surface 410*b* and the support surface 410*a* may be an angle that is greater than 0 degree (0°) and less than 90 degrees (90°). As an illustration, in at least some embodiments, the angle A between the connection surface 410*b* and the support surface 410*a* may be, for example but not limited to, substantially 45 degrees (45°). In other embodiments, the angle A between the connection surface 410*b* and the support surface 410*a* may be an acute angle suitable to the particular design, e.g., 30 or 60 degrees, so that the general direction of light emitted from the light source 420 is tilted relative to the affixation terminal.

In at least some embodiments, the main body 410 may include a light incident plane 410*d* defined by an opening of a receiving slot 410*c* on the main body 410. The light incident plane 410*d* may be parallel with the support surface 410*a* as shown in FIG. 8. An angle B between the light incident plane 410*d* and the support surface 410*a* may be between 0 degree (0°) and 90 degrees (90°), and the present invention is not limited to any particular angle between the light incident plane 410*d* and the support surface 410*a*. In the example shown in FIGS. 7 and 8, the angle B may be 0 degree as the light incident plane 410*d* may be parallel with the support surface 410*a*, and accordingly angle B is not shown in FIG. 8.

In at least some embodiments, the main body 410 may include a base 412 and one or more terminals 414. Each of the one or more terminals 414 may be electrically conductive, thermally conductive, or both electrically and thermally conductive. The support surface 410*a* may be formed on the base 412. At least one of the one or more terminals 414 may be electrically connected to the light source 420 for connecting electrical power to the light source 420. In one embodiment, at least one of the one or more terminals 414 is electrically connected to the light source 420 for connecting electrical power to the light source 420 while at least another one of the one or more terminals 414 is not electrically connected to the light source 420 but used for structurally attaching the main body 410 to the affixation terminal 432. Each of the one or more terminals 414 may include a welding portion 414*a* and a connection portion 414*b*. The one or more welding portions 414*a* may form the connection surface 410*b* and may be welded to a surface of the circuit board 430 (i.e., the affixation terminal 432) so that the light source 420 is electrically connected to the circuit board 430 through one or more of the terminals 414.

In at least some embodiments, the one or more terminals 414 may extend in different directions from a region where the main body 410 and the light source 420 are connected toward a bottom surface 410*e* that is opposite to and optionally parallel with the support surface 410*a*, and may lay flat against a side surface of the base 412 to extend along the side surface of the base 412 with the connection portions 414*b* and the welding portions 414*a* disposed on the side surface of the base 412. In other words, the one or more terminals 414 at least partially wrap around the base 412. More specifically, when there are more than one terminal 414, at least one of the terminals 414 at least partially wraps around the base 412 in a clockwise direction while at least one other terminal 414 at least partially wraps around the base 412 in a counterclockwise direction when viewed from a given side of the base 412. In the example shown in FIGS. 7 and 8, the terminals 414 include eight terminals, namely terminals $\mathbf{414}_1$-$\mathbf{414}_8$, and two of them ($\mathbf{414}_1$ and $\mathbf{414}_8$) partially wrap around the base 412 in one direction while the other six ($\mathbf{414}_2$-$\mathbf{414}_7$) partially wrap around the base 412 in the other direction. More specifically, as shown in FIGS. 7 and 8, terminals $\mathbf{414}_1$ and $\mathbf{414}_8$ wrap around the base 412 in a clockwise direction as viewed from a side shown in FIG. 8, by extending from the support surface 410*a* to the back surface 410*e* and then down to be in contact with the affixation terminal 432. In contrast, terminals $\mathbf{414}_2$-$\mathbf{414}_7$ wrap around the base 412 in a counter-clockwise direction as viewed from the same side shown in FIG. 8. In other embodiments, terminals $\mathbf{414}_2$-$\mathbf{414}_7$ may wrap around the base 412 in a clockwise direction while terminals $\mathbf{414}_1$ and $\mathbf{414}_8$ may wrap around the base 412 in a counter-clockwise direction. By having the terminals 414 wrap around the base 412 in different direction, the affixation of the main body 410 to the affixation terminal 432 is reinforced. Thus, an advantage of having the terminals 414 wrap around the base 412 in different directions is that the main body 410 of the light emitting device 400 would not be easily tilted or otherwise rotated by an user, whether intentionally or unintentionally, when the light emitting device 400 is partially or entirely exposed and hence subject to physical contact by the user.

In one embodiment, the light source 420 is electrically connected to the circuit board 430 through terminals $\mathbf{414}_2$-$\mathbf{414}_7$, while terminals $\mathbf{414}_1$ and $\mathbf{414}_8$ provide structural support to prevent inadvertent rotation or turning of the main body 410. That is, although terminals $\mathbf{414}_1$ and $\mathbf{414}_8$ may be in contact with the surface 432 of the circuit board 430, terminals $\mathbf{414}_1$ and $\mathbf{414}_8$ may not be electrically connected to an electrode on the circuit board 430 to conduct electricity as their function is structurally preventing the rotation or turning of the main body 410. In other embodiments, the number of terminals 414 used for connecting electrical power to the light source 420 may differ, and the number of terminals 414 used for structural support but not for connecting electrical power may also differ. Further, although in the example shown in FIGS. 7 and 8 the terminals that provide structural support, namely $\mathbf{414}_1$ and $\mathbf{414}_8$, are located on the two ends of the array of terminals 414, in other embodiments the one or more terminals that provide structural support may be located elsewhere (e.g., being sandwiched between two other terminals that supply electrical power to the light source).

Under traditional configurations, the light source is usually parallel with or perpendicular to the circuit board. As such a user would need to tilt the circuit board in order to tilt the general direction of the light emitted from the light emitting device. In contrast, given the built-in tilting of the support surface 410*a* of the main body 410 relative to the circuit board 430, in the present embodiment there is no need to tilt the circuit board 430 in order to tilt the general direction of light emitted from the light emitting device 400.

In at least some embodiments, the main body 410 may include one or more supporting portions 416. FIG. 7 and FIG. 8 show that two supporting portions 416, disposed on the two ends of the main body 410, protrude from the main body 410 and come in direct contact with the affixation terminal 432 (which is a surface of the circuit board 430) to support the main body 410 at an angle relative to the affixation terminal 432 so that the entire structure is sturdy. It would be appreciated by those skilled in the art that, although two supporting portions 416 are shown in the example of FIG. 7, in other embodiments the actual quantity of the supporting portions 416 may be more or less (e.g., one, three or four) than that shown in FIG. 7. For example, in one embodiment, the main body 410 may have one supporting portion 416 and, in another embodiment, the main body 410 may have three supporting portions 416, and so on.

The above-described light emitting devices 100, 200, 300 and 400 may be surface mounted device-type light emitting devices, but the present invention is not limited thereto. In other embodiments, each of the light emitting devices 100, 200, 300 and 400 may be one of other types of devices.

Figure 9:
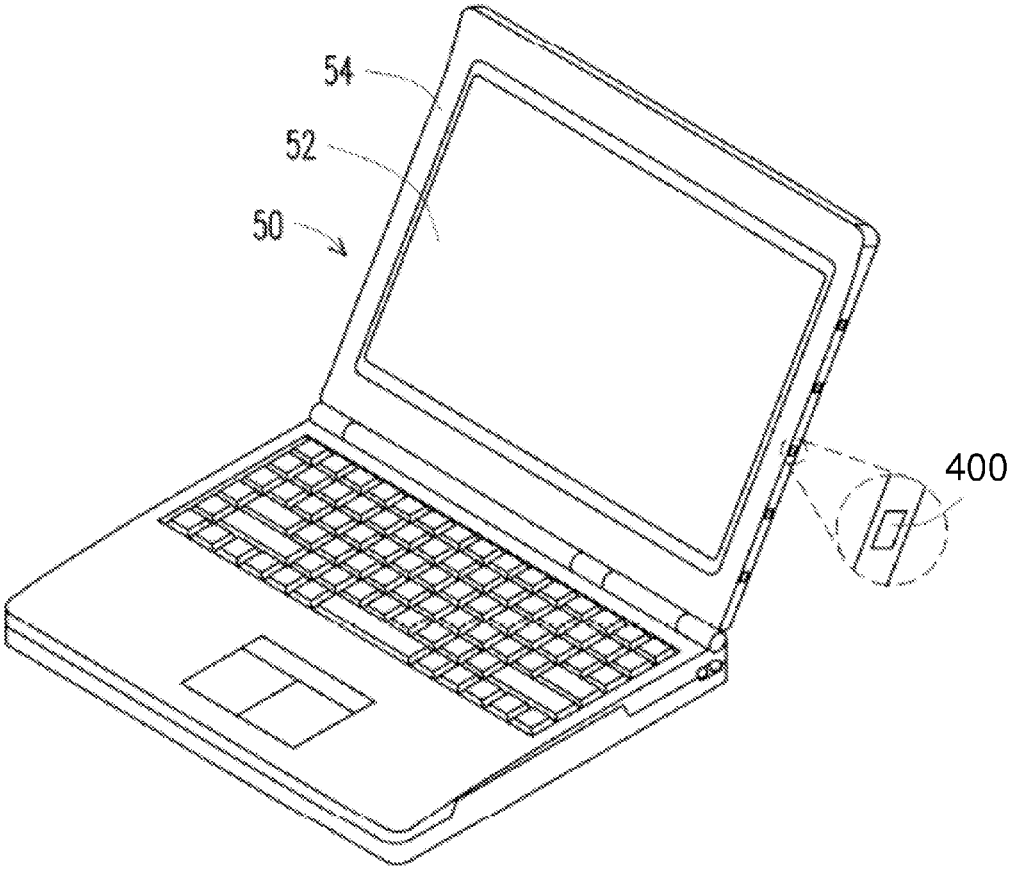
FIG. 9 is a diagram showing an example application of a light emitting device in a display device in accordance with an embodiment of the present invention.

In at least some embodiments, the light emitting devices of the present invention may be employed in display devices and the following description uses the light emitting device 400 as an example for illustration. FIG. 9 illustrates an example application of the light emitting device 400 in a display device 50. Referring to FIG. 9, the display device 50 may include a display panel 52, a frame 54, and one or more light emitting devices 400. The frame 54 may be configured to accommodate or otherwise receive the display panel 52 therein, and the one or more light emitting devices 400 may be embedded around a periphery of the frame 54 to emit light outwardly in various angles. Accordingly, a design of colorful lighting may be implemented in a conventional frame 54 by utilizing a light emitting device of the present invention which emits light generally in a tilted direction due to an angle between a support surface and a connection surface. In other embodiments, the light emitting device 100, 200 or 300 may be implemented in the frame of a display device depending on the requirements for the appearance and other design considerations, and the present invention is not limited thereto. It would be appreciated by those skilled in the art that, in various embodiments, the display device 50 may include one or more light emitting devices 100, one or more light emitting devices 200, one or more light emitting devices 300, or one or more light emitting devices 400. Although multiple light emitting devices 400 are shown in the example of FIG. 9, in other embodiments the display device 50 may have more or less light emitting devices 100, 200, 300 or 400. Further, in at least some embodiments, the display device 50 may include one or more conventional light emitting device without the tilting feature of the present invention in addition to at least one light emitting device 100, 200, 300 or 400 of the present invention.

In at least some embodiments, the light emitting device may include a white light LED, which may include a blue light LED chip and yellow fluorescent powder. Alternatively or additionally, the white light LED may include a red light LED chip or red fluorescent powder. In at least some other embodiments, the white light LED may include one or more red light LED chips, one or more green light LED chips and one or more blue light LED chips. Additionally, the white light LED may include yellow fluorescent power and may further include red fluorescent power. In at least some alternative embodiments, the light emitting device may include one or more red, green or blue light LED chips. More specifically, the fluorescent powder may be distributed uniformly, unevenly, or in a graduated manner in terms of concentration in the above-described translucent encapsulant.

The light emitting device of various embodiments of the present invention may be employed in applications such as, for example, indoor lighting, outdoor lighting, automotive, backlight module, display of character segments, situational applications, plant use and special applications such as green energy products.

In summary, in a light emitting device of the present invention, the main body includes a connection surface and a support surface with an angle therebetween. Thus, as the main body is connected to the affixation terminal via the connection surface, the general direction of light emitted from the light source, which is disposed on the support surface, is tilted relative to the affixation terminal. As a result there is no need for additional components to support the main body to render the tilting in the direction of light emission, thereby saving manufacturing cost and reducing assembly time.

It is specifically contemplated that any feature disclosed herein with respect to one embodiment or one figure of the present disclosure may apply to any other embodiment of the present disclosure. More specifically, although any given feature may be described above in connection with one or more particular embodiments or figures, such feature may be applied in any combination with any other feature with respect to all other embodiments and figures, and variations thereof, without departing from the spirit of the present disclosure and so long as such feature does not contradict with one or more features of the other embodiments and figures.

Although a number of embodiments of the present invention are described above, the scope of the present invention is not and cannot be limited to the disclosed embodiments. More specifically, one ordinarily skilled in the art may make various deviations and improvements based on the disclosed embodiments, and such deviations and improvements are still within the scope of the present invention. Accordingly, the scope of protection of a patent issued from the present invention is determined by the claims provided below.

What is claimed is:

1. A light emitting device, comprising:

a main body, comprising:

a base having a support surface; and a plurality of terminals each of which respectively having a welding portion such that the welding portions of the terminals form a connection surface with a first angle between the support surface and the connection surface, wherein the first angle is between 0 degree and 90 degrees; and a light source disposed on the support surface and electrically connected to one or more of the terminals, wherein the main body further comprises a receiving slot in which the support surface and the light source are disposed, wherein an opening of the receiving slot defines a light incident plane on the main body, wherein the light incident plane and the support surface are substantially parallel to each other, and wherein at least a first terminal and a second terminal of the plurality of terminals are disposed on same surfaces of the base and are substantially parallel to each other on each surface of the base on which the first terminal and the second terminal are disposed.

2. The light emitting device of claim 1, wherein the first angle is substantially 45 degrees.

3. The light emitting device of claim 1, wherein the main body further comprises at least one supporting portion protruding from the base, wherein the at least one supporting portion maintains a second angle between the main body and an affixation terminal when the main body is disposed on the affixation terminal with the supporting portion in contact with the affixation terminal.

4. The light emitting device of claim 1, wherein at least a first one of the terminals extends from a region where the main body and the light source are connected in a first direction around a side surface of the base and toward a bottom surface of the base that is opposite to the support surface, wherein at least a second one of the terminals extends from the region where the main body and the light source are connected in a second direction around the side surface of the base and toward the bottom surface of the base, and wherein the first direction and the second direction are opposite to each other.

5. A surface mounted device-type light emitting device, comprising:

a main body, comprising:

a base having a support surface; and a plurality of terminals each of which respectively having a welding portion, the welding portions of the terminals forming a connection surface such that the support surface is tilted relative to the connection surface with a first angle between the connection surface and the support surface, wherein the first angle is between 0 degree and 90 degrees; and a light-emitting diode (LED) chip disposed on the support surface and electrically connected to one or more of the terminals, wherein the main body further comprises a receiving slot in which the support surface and the LED are disposed, wherein an opening of the receiving slot defines a light incident plane on the main body, wherein the light incident plane and the support surface are substantially parallel to each other, and wherein at least a first terminal and a second terminal of the plurality of terminals are disposed on same surfaces of the base and are substantially parallel to each other on each surface of the base on which the first terminal and the second terminal are disposed.

6. The surface mounted device-type light emitting device of claim 5, wherein the first angle is substantially 45 degrees.

7. The surface mounted device-type light emitting device of claim 5, wherein the main body further comprises a translucent encapsulant filled in the receiving slot of the main body and covering the LED chip.

8. The surface mounted device-type light emitting device of claim 5, wherein the main body further comprises at least one supporting portion protruding from the base, wherein the at least one supporting portion maintains a second angle between the main body and an affixation terminal when the main body is disposed on the affixation terminal with the supporting portion in contact with the affixation terminal.

9. The surface mounted device-type light emitting device of claim 5, wherein at least a first one of the terminals extends from a region where the main body and the LED chip are connected in a first direction around a side surface of the base and toward a bottom surface of the base that is opposite to the support surface, wherein at least a second one of the terminals extends from the region where the main body and the LED chip are connected in a second direction around the side surface of the base and toward the bottom surface of the base, and wherein the first direction and the second direction are opposite to each other.

10. A display device, comprising:

a display panel;

a frame in which the display panel is received; and a plurality of light emitting devices embedded in the frame, each of the light emitting devices respectively comprising:

a main body, comprising:

a base having a support surface; and a plurality of terminals each of which respectively having a welding portion such that the welding portions of the terminals form a connection surface, wherein the support surface is tilted relative to the connection surface; and a light source disposed on the support surface and electrically connected to one or more of the terminals, wherein the main body of at least one of the light emitting devices further comprises at least one supporting portion protruding from the respective base, wherein the at least one supporting portion maintains an angle between the main body and an affixation terminal when the main body is disposed on the affixation terminal with the supporting portion in contact with the affixation terminal.

11. The display device of claim 10, wherein the support surface is tilted relative to the connection surface by a first angle, and wherein the first angle is between 0 degree and 90 degrees.

12. The display device of claim 10, wherein the main body of at least one of the light emitting devices further comprises a receiving slot in which the respective support surface and light source are disposed, wherein an opening of the receiving slot defines a light incident plane with a second angle between the light incident plane and the support surface, and wherein the second angle is between 0 degree and 90 degrees.

13. The display device of claim 10, wherein at least a first one of the terminals extends from a region where the main body and the light source are connected in a first direction around a side surface of the base and toward a bottom surface of the base that is opposite to the support surface, wherein at least a second one of the terminals extends from the region where the main body and the light source are connected in a second direction around the side surface of the base and toward the bottom surface of the base, and wherein the first direction and the second direction are opposite to each other.

* * * * *